US007557504B2

(12) United States Patent
Tachibana et al.

(10) Patent No.: US 7,557,504 B2
(45) Date of Patent: Jul. 7, 2009

(54) PLASMA DISPLAY PANEL WITH PRIMING DISCHARGE CELL

(75) Inventors: Hiroyuki Tachibana, Suita (JP); Morio Fujitani, Takatsuki (JP); Tsuyoshi Nishio, Mino (JP); Toru Ando, Osaka (JP); Koichi Mizuno, Kusatsu (JP)

(73) Assignee: Panasonic Corporation, Osaka (JP)

( * ) Notice: Subject to any disclaimer, the term of this patent is extended or adjusted under 35 U.S.C. 154(b) by 528 days.

(21) Appl. No.: 10/504,960

(22) PCT Filed: Mar. 25, 2004

(86) PCT No.: PCT/JP2004/004139

§ 371 (c)(1),
(2), (4) Date: Aug. 18, 2004

(87) PCT Pub. No.: WO2004/086445

PCT Pub. Date: Oct. 7, 2004

(65) Prior Publication Data

US 2005/0099125 A1 May 12, 2005

(30) Foreign Application Priority Data

Mar. 27, 2003 (JP) ..... 2003-088457

(51) Int. Cl.
*H01J 17/49* (2006.01)

(52) U.S. Cl. ..... 313/582; 313/581; 313/292; 345/60

(58) Field of Classification Search ..... 313/582–587, 313/292, 238, 581; 345/60
See application file for complete search history.

(56) References Cited

U.S. PATENT DOCUMENTS

| | | | | |
|---|---|---|---|---|
| 5,818,168 | A | 10/1998 | Ushifusa et al. | |
| 6,313,580 | B1 * | 11/2001 | Makino | 313/582 |
| 6,496,167 | B2 * | 12/2002 | Makino | 345/60 |
| 6,674,238 | B2 * | 1/2004 | Otani et al. | 313/587 |
| 7,030,562 | B2 * | 4/2006 | Tachibana et al. | 313/583 |
| 7,084,569 | B2 * | 8/2006 | Tachibana et al. | 313/583 |
| 7,151,343 | B2 * | 12/2006 | Tachibana et al. | 313/586 |
| 7,176,856 | B2 * | 2/2007 | Yahagi et al. | 345/68 |
| 2001/0011871 | A1 * | 8/2001 | Amemiya et al. | 313/586 |
| 2002/0101181 | A1 | 8/2002 | Lee et al. | |
| 2002/0163304 | A1 * | 11/2002 | Akiba | 313/584 |
| 2005/0040766 | A1 * | 2/2005 | Tachibana et al. | 313/586 |

FOREIGN PATENT DOCUMENTS

| | | |
|---|---|---|
| JP | 11-297211 | 10/1999 |
| JP | 2001-195990 | 7/2001 |
| JP | 2001-216901 | 8/2001 |
| JP | 2002-169507 | 5/2002 |
| JP | 2002-190256 | 7/2002 |
| JP | 2002-297091 | 10/2002 |

* cited by examiner

*Primary Examiner*—Karabi Guharay
(74) *Attorney, Agent, or Firm*—Steptoe & Johnson LLP

(57) ABSTRACT

A plasma display panel can reduce a discharge delay in address discharge, thereby performing high-speed addressing in a stable manner. A front substrate (1) and a back substrate (2) are disposed to face each other, and a discharge space (3) is formed and partitioned by barrier ribs (10) so as to form priming discharge cells (17) and main discharge cells (11). A clearance (19) is provided between the barrier ribs (10) of the priming discharge cells (17) and the front substrate (1), and priming particles generated in the priming discharge cells (17) are supplied to the main discharge cells (11) through the clearance (19), whereby a PDP performing high-speed addressing is obtained.

8 Claims, 8 Drawing Sheets

PLASMA DISPLAY PANEL WITH PRIMING DISCHARGE CELL

TECHNICAL FIELD

The present invention relates to plasma display panels used for wall-hung TVs and large-size monitors.

BACKGROUND ART

An AC surface discharge type plasma display panel (hereinafter referred to as PDP), which is a typical AC type PDP, is formed of a front plate made of a glass substrate having scan electrodes and sustain electrodes provided thereon for a surface discharge, and a back plate made of a glass substrate having data electrodes provided thereon. The front plate and the back plate are disposed to face each other in parallel in such a manner that the electrodes on both plates form a matrix, and that a discharge space is formed between the plates. And the outer part of the plates thus combined is sealed with a sealing member such as a glass frit. Between the substrates, discharge cells partitioned by barrier ribs are formed, and phosphor layers are provided in the cell spaces formed by the barrier ribs. In a PDP with this structure, ultraviolet rays are generated by gas discharge and used to excite and illuminate phosphors for red, green and blue, thereby performing a color display (See Japanese Laid-Open Patent Application No. 2001-195990).

In this PDP, one field period is divided into a plurality of sub fields, and sub fields during which to illuminate phosphors are combined so as to drive the PDP for a gradation display. Each sub field consists of an initialization period, an address period and a sustain period. For displaying image data, each electrode is applied with signals different in waveform between the initialization, address and sustain periods.

In the initialization period, all scan electrodes are applied with, e.g. a positive pulse voltage so as to accumulate a necessary wall charge on a protective layer provided on a dielectric layer covering the scan electrodes and the sustain electrodes, and also on the phosphor layers.

In the address period, all scan electrodes are scanned by being sequentially applied with a negative scan pulse, and when there are display data, a positive data pulse is applied to the data electrodes while the scan electrodes are being scanned. As a result, a discharge occurs between the scan electrodes and the data electrodes, thereby forming a wall charge on the surface of the protective layer provided on the scan electrodes.

In the subsequent sustain period, for a set period of time, a voltage enough to sustain a discharge is applied between the scan electrodes and the sustain electrodes. This voltage application generates a discharge plasma between the scan electrodes and the sustain electrodes, thereby exciting and illuminating phosphor layers for a set period of time. In a discharge space where no data pulse has been applied during the address period, no discharge occurs, causing no excitation or illumination of the phosphor layers.

In this type of PDP, a large delay in discharge occurs during the address period, thereby making the address operation unstable, or completion of the address operation requires a long address time, thereby spending too much time for the address period. In an attempt to solve these problems, there have been provided a PDP in which auxiliary discharge electrodes are provided on a front plate, and a discharge delay is reduced by a priming discharge generated by an in-plane auxiliary discharge on the front plate side, and a method for driving the PDP (See Japanese Laid-Open Patent Application No. 2002-297091).

However, in these conventional PDPs, when the number of discharge cells is increased as a result of achieved higher definition, more time must be spent for the address time and less time must be spent for the sustain period, thereby making it difficult to achieve high brightness or high gradation. Furthermore, since the address properties are greatly affected by the address process, it is demanded to reduce a discharge delay during the addressing, thereby accelerating the address time.

In spite of this demand, in conventional PDPs performing a priming discharge in the front plate surface, a discharge delay during the addressing cannot be reduced sufficiently; the operating margin of an auxiliary discharge is small; and a false discharge is induced to make the operation unstable. Moreover, since the auxiliary discharge is performed in the front plate surface, more priming particles than necessary for priming are applied to an adjacent discharge cell, thereby causing crosstalk.

The present invention, which has been contrived in view of the aforementioned problems, has an object of providing a PDP which stably supplies a discharge cell with priming particles generated by a priming discharge so as to reduce a delay in address discharge, thereby stabilizing address properties and securing exhaust system.

SUMMARY OF THE INVENTION

In order to achieve the object, a PDP of the present invention comprises: a first electrode and a second electrode which are disposed in parallel with each other on a first substrate; a third electrode disposed on a second substrate in a direction orthogonal to the first electrode and the second electrode, the second substrate being disposed to face the first substrate with a discharge space therebetween; a fourth electrode disposed on the second substrate in such a manner as to be parallel with the first electrode and the second electrode; and a first discharge space and a second discharge space which are formed on the second substrate by being partitioned by a barrier rib, wherein a main discharge cell for performing a discharge with the first electrode, the second electrode and the third electrode is formed in the first discharge space, and a priming discharge cell for performing a discharge with the fourth electrode and at least one of the first electrode and the second electrode is formed in the second discharge space, and the barrier rib crossing the third electrode, and the first substrate have a clearance therebetween.

With this structure, discharge cells are divided into a first discharge space, which is a main discharge cell for displaying image data, and a second discharge space, which is a priming discharge cell. And the main discharge cell is stably supplied with priming particles generated inside the priming discharge cell through the clearance so as to reduce a discharge delay. It also becomes possible to improve exhaust performance in the discharge cells.

DETAILED DESCRIPTION OF PREFERRED EMBODIMENTS

Embodiments of the present invention will be described as follows with reference to accompanying drawings.

First Exemplary Embodiment

Figure 1:
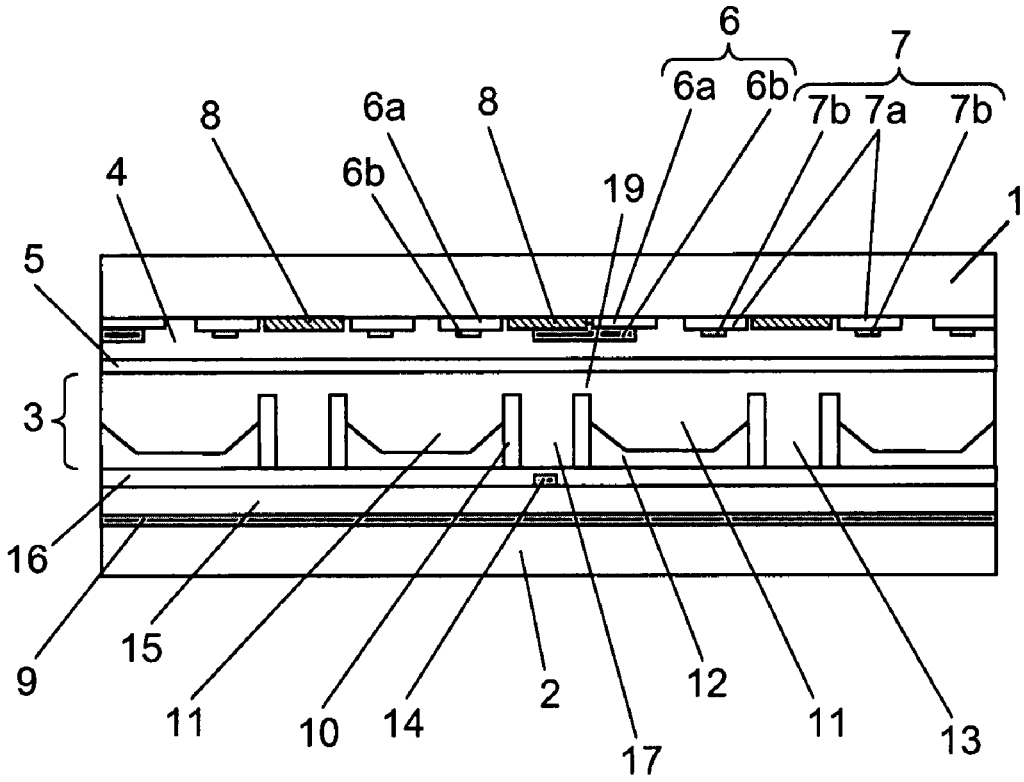
FIG. 1 is a cross sectional view of a PDP according to a first embodiment of the present invention.
Figure 2:
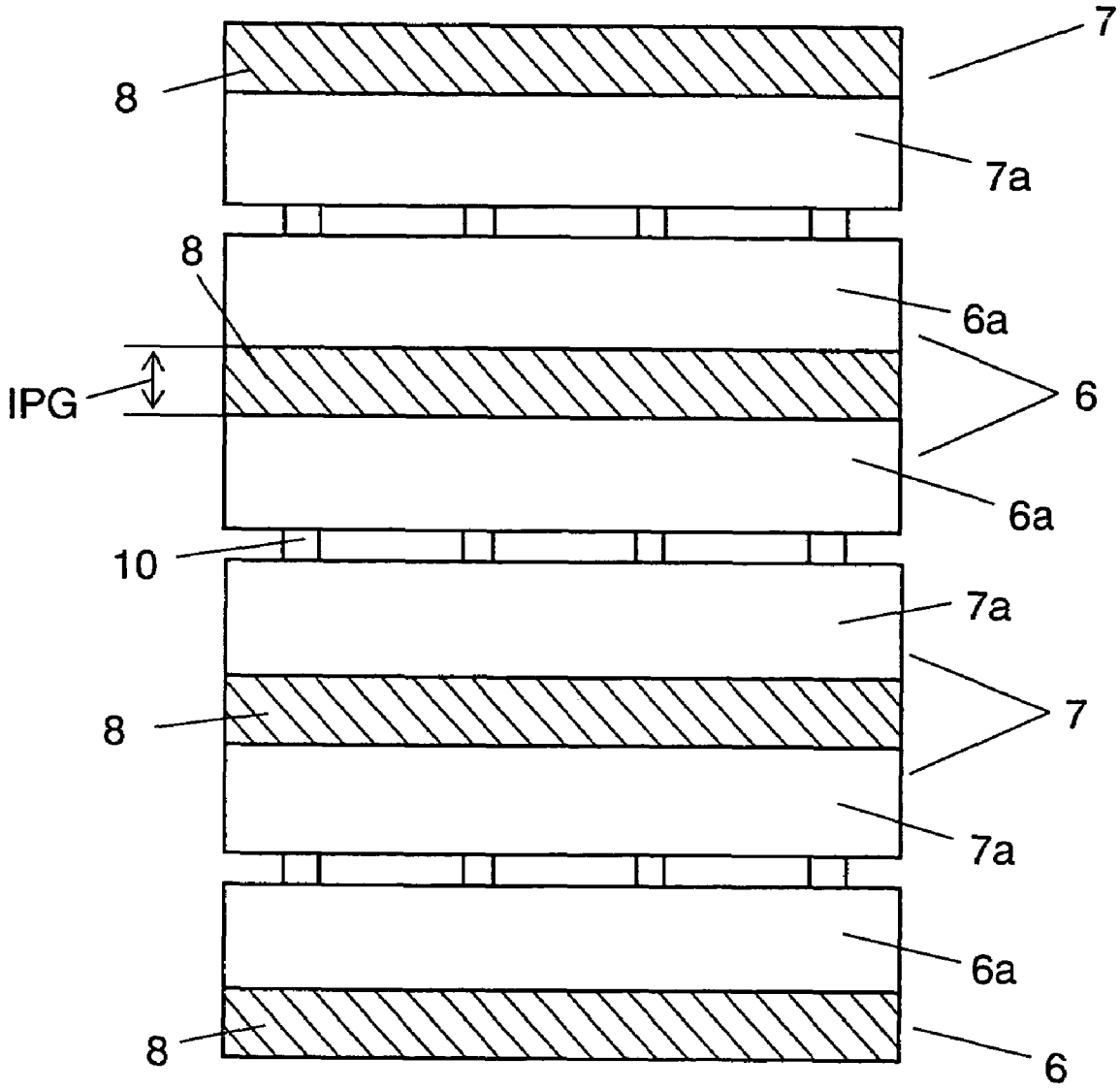
FIG. 2 is a schematic plan view showing an electrode arrangement on a front substrate side of the PDP according to the first embodiment of the present invention.
Figure 3:
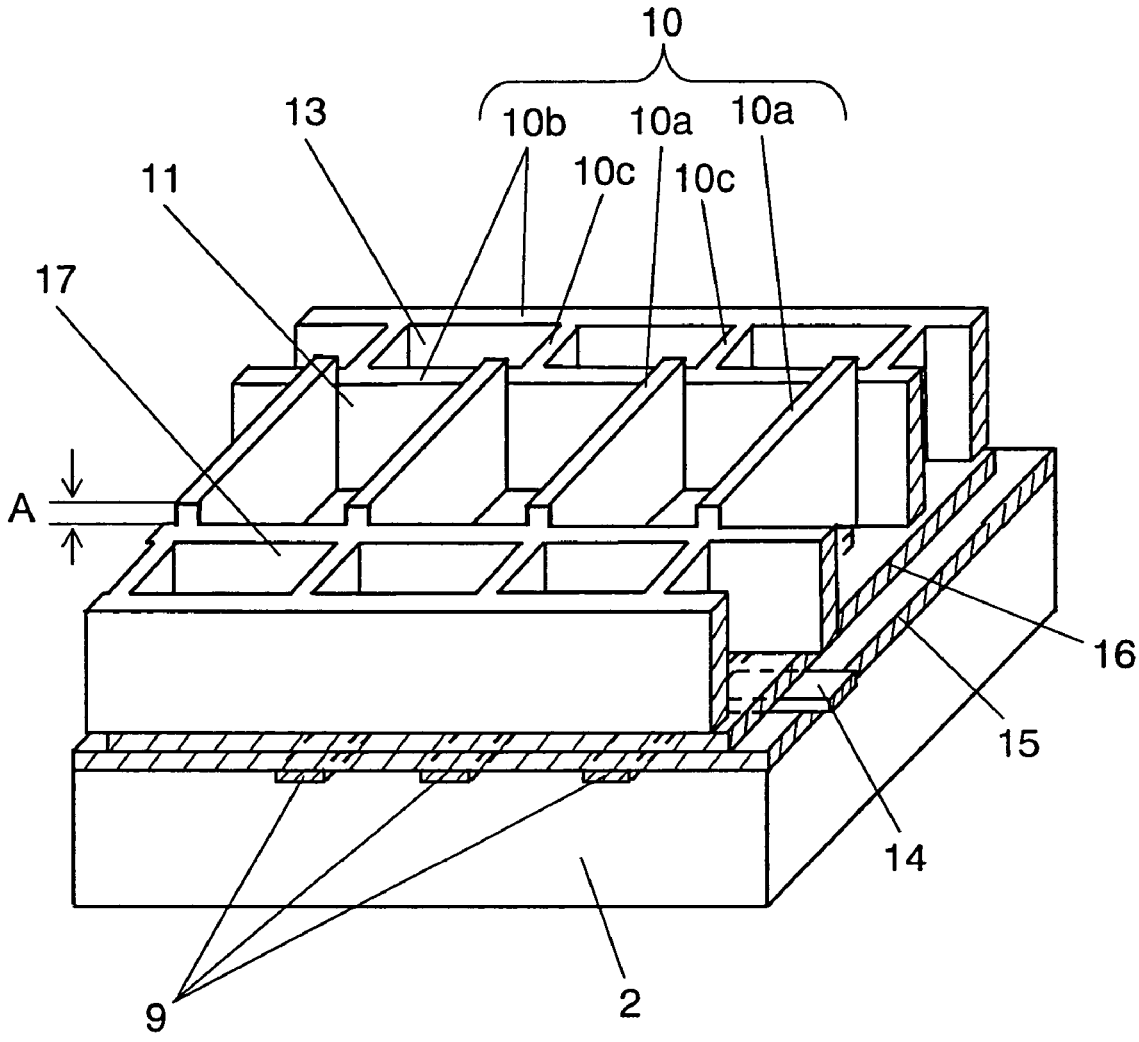
FIG. 3 is a schematic perspective view showing a back substrate side of the PDP according to the first embodiment of the present invention.

FIG. 1 is a cross sectional view of a PDP according to a first embodiment of the present invention, and FIG. 2 is a schematic plan view showing an electrode arrangement on a front substrate side, which is a first substrate side of the PDP according to the first embodiment of the present invention. FIG. 3 is a schematic perspective view showing a back substrate side, which is a second substrate side of the PDP according to the first embodiment of the present invention.

As shown in FIG. 1, the PDP according to the present invention includes front substrate 1 which is a first substrate made of glass, and back substrate 2 which is a second substrate made of glass disposed to face each other with discharge space 3 therebetween, and discharge space 3 is sealed with neon, xenon and the like as gasses for irradiating ultraviolet rays by discharge. On front substrate 1, a group of belt-shaped electrodes consisting of pairs of scan electrodes 6 as first electrodes and sustain electrodes 7 as second electrodes are disposed in parallel with each other in such a manner as to be covered with dielectric layer 4 and protective layer 5. Scan electrodes 6 and sustain electrodes 7 are respectively formed of transparent electrodes 6*a* and 7*a*, and metal bus bars 6*b* and 7*b*, which are respectively laid on transparent electrodes 6*a* and 7*b*, and which are made of silver or the like for improving conductivity.

As shown in FIG. 2, scan electrodes 6 and sustain electrodes 7 are disposed alternately, two by two, so that scan electrode 6-scan electrode 6-sustain electrode 7-sustain electrode 7, . . . are arranged in that order, and light absorption layers 8 made of black colored material are each disposed between two adjacent sustain electrodes 7, and between two adjacent scan electrodes 6.

On the other hands, as shown in FIGS. 1 and 3, back substrate 2 is provided thereon with a plurality of belt-shaped data electrodes 9 which are third electrodes disposed in parallel with each other in the direction orthogonal to scan electrodes 6 and sustain electrode 7. Back substrate 2 is also provided thereon with barrier ribs 10 for partitioning a plurality of discharge cells formed by scan electrodes 6, sustain electrodes 7 and data electrodes 9. And barrier ribs 10 form main discharge cells 11 which are first discharge spaces and priming discharge cells 17 which are second discharge spaces, and at least main discharge cells 11 are provided with phosphor layers 12 of red, green or blue corresponding to the color of each of main discharge cells 11. Barrier ribs 10 are formed of longitudinal rib parts 10*a*, 10*c* extending in the direction orthogonal to scan electrodes 6 and sustain electrodes 7 provided on front substrate 1, namely in the direction parallel to data electrodes 9, and of lateral rib parts 10*b* crossing longitudinal rib parts 10*a* to form main discharge cells 11, and also to form gap parts 13 between main discharge cells 11. Light absorption layers 8 on front substrate 1 correspond in position to gap parts 13 formed between lateral rib parts 10*b* of barrier ribs 10 and priming discharge cells 17.

Of gap parts 13 formed on back substrate 2, gap parts 13 that form priming discharge cells 17 are provided therein with priming electrodes 14 which are fourth electrodes for causing a priming discharge between scan electrodes 6 on front substrate 1 and back substrate 2 in the direction parallel to scan electrodes 6.

Priming electrodes 14 are formed on dielectric layer 15 covering data electrodes 9, and dielectric layer 16 is formed to cover priming electrodes 14, which therefore are provided closer to scan electrodes 6 than data electrodes 9. Furthermore, priming electrodes 14 are formed exclusively in gap parts 13 corresponding to regions where scan electrodes 6 applied with a scan pulse are adjacent to each other, and some of metal bus bars 6*b* of scan electrodes 6 are extended to the position corresponding to priming discharge cells 17 and formed on light absorption layers 8. In other words, of scan electrodes 6 adjacent to each other, a priming discharge is performed between metal bus bars 6*b* projecting towards the regions of priming discharge cells 17 and priming electrodes 14 formed on back substrate 2 side.

Lateral rib pats 10*b* at least crossing data electrodes 9 which are third electrodes have clearance 19 with protective layer 5 formed on front substrate 1. In FIG. 3, priming discharge cells 17 and gap pars 13 with no priming electrodes 14 are provided with longitudinal rib parts 10*c* in the same manner as in main discharge cells 11, and also with lateral rib parts 10*b* and longitudinal rib parts 10*c* which are made lower by height difference A than lateral rib parts 10*a* formed in main discharge cells 11. Height difference A, that is, the spacing between clearance 19 and front substrate 1 is set to not less than 31 μm nor more than 10 μm.

Figure 4:
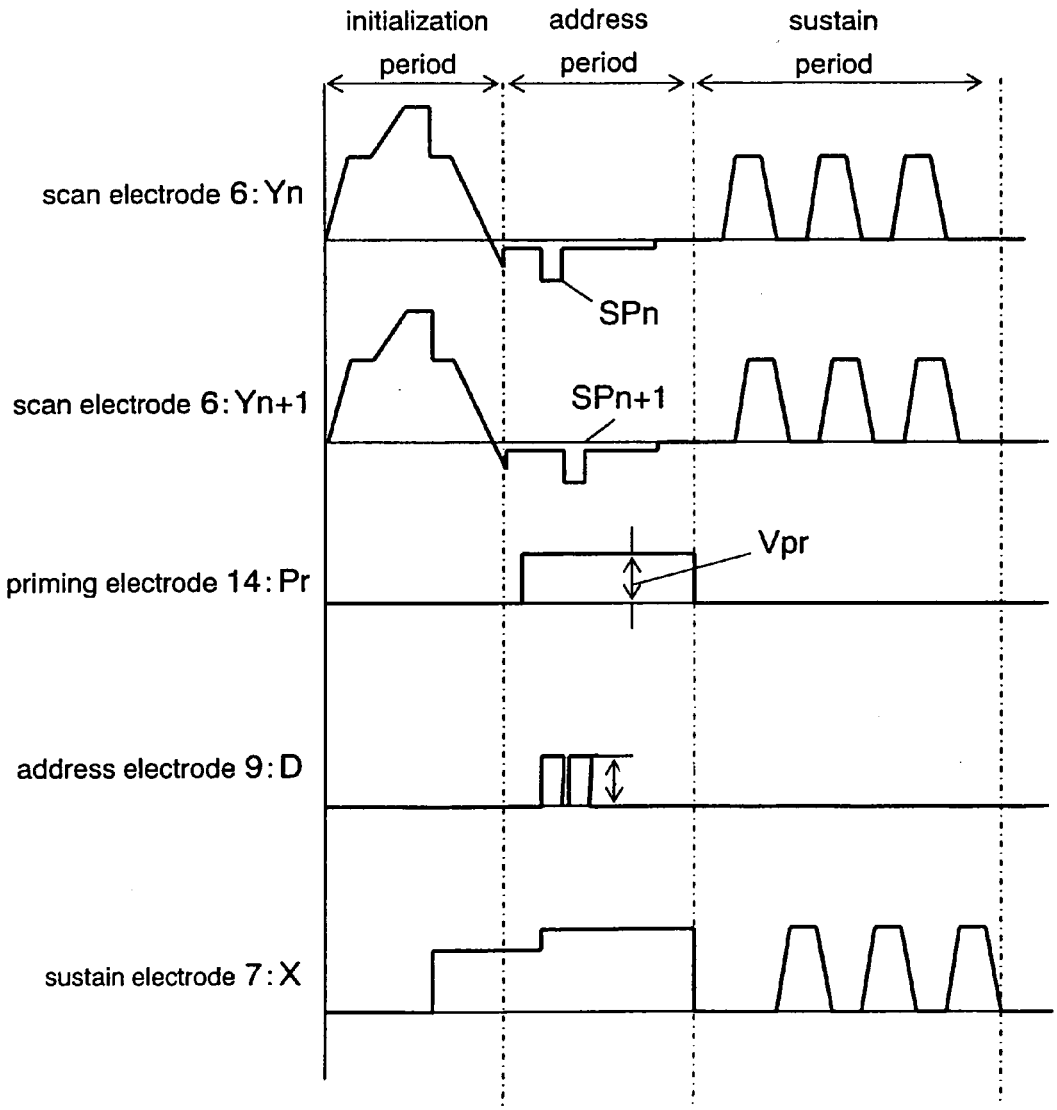
FIG. 4 is a waveform chart showing an example of waveforms for driving the PDP according to the first embodiment of the present invention.

Next, a method for displaying image data on the PDP will be described as follows. In order to drive the PDP, one field period is divided into a plurality of sub fields having a weight of an illumination period based on the binary system, and a gradation display is performed by a combination of sub fields during which to illuminate phosphors. Each sub field consists of an initialization period, an address period and a sustain period. FIG. 4 is a waveform chart showing an example of waveforms for driving the PDP according to the first embodiment of the present invention. During the initialization period shown in FIG. 4, main discharge cells 11 are initialized between scan electrodes 6 and data electrodes 9, and priming discharge cells 17 are initialized between scan electrodes 6 that project into the regions of priming discharge cells 17, and priming electrodes 14. Next, in the address period, which is a period for addressing display data and non-display data to main discharge cells 11, priming electrodes 14 are constantly applied with a positive potential as shown in FIG. 4.

Consequently, in priming discharge cells 17, when scan electrode Yn, which is the n-th of scan electrodes 6, is applied with scan pulse SPn, a priming discharge occurs between priming electrode 14 and n-th scan electrode Yn.

According to the present invention, in priming discharge cells 17 and gap parts 13 having no priming electrodes 14, lateral rib parts 10*b* and longitudinal rib parts 10*c* are made lower in height by height difference A, thereby providing clearance 19. Consequently, priming particles generated in priming discharge cells 17 are stably supplied to main discharge cells 11 through clearance 19, thereby reducing a discharge delay in address discharge at the time of addressing display data in main discharge cells 11. Furthermore, at the time of addressing non-display data, stable address properties can be obtained without the occurrence of a data address error due to false discharge. In addition, since longitudinal rib parts 10*a* forming main discharge cells 11 are in contact with front substrate 1, crosstalk between adjacent main discharge cells can be reduced.

In addition, according to the present invention, lateral rib parts 10*b* forming gap parts 13 having no priming electrodes 14 are also provided with clearance 19 with protective layer 5. This improves exhaust performance in the discharge cells, thereby facilitating to exhaust impurity gas.

It goes without saying that providing clearance 19 exclusively between barrier ribs 10 of priming discharge cells 17 and protective layer 5 has an effect of reducing a discharge delay at the time of addressing.

Next, scan electrode Yn+1, which is the n+1th of scan electrodes 6 is applied with scan pulse SPn+1; however, since a priming discharge has occurred immediately before this, a discharge delay at the time of addressing n+1th main discharge cells 11 can be reduced. Although the driving sequence in one sub field has been described hereinbefore, the other sub fields have the same operation principle.

As described hereinbefore, the present invention can achieve a PDP with a stable supply of priming particles to main discharge cells 11, and also with improved exhaust performance.

Figure 5:
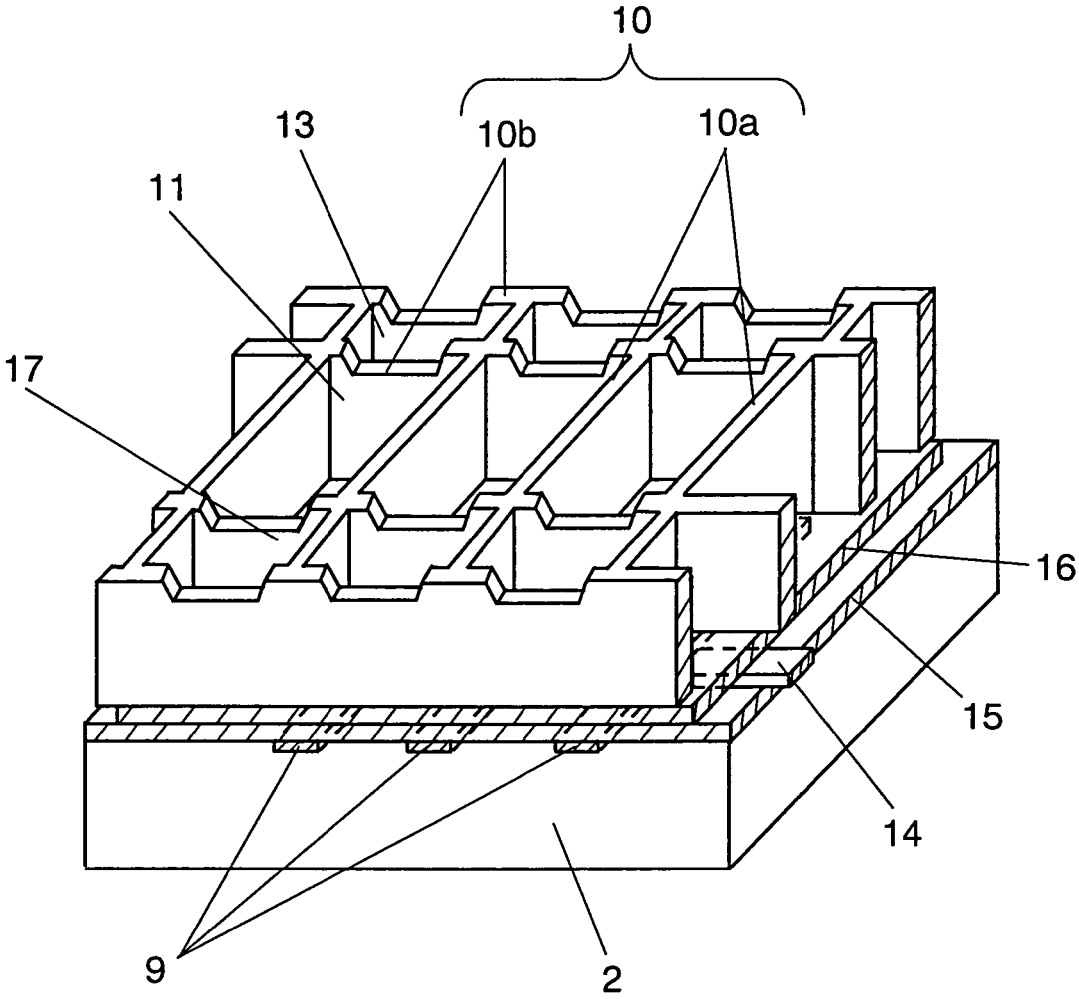
FIG. 5 is a schematic perspective view showing a back substrate side of another example of the PDP according to the first embodiment of the present invention.

Although the heights of barrier ribs 10 in priming discharge cells 17 are uniformly made low in the above description, the same effects can be obtained by lowering lateral rib parts 10*b* in parts as shown in FIG. 5 or providing guide parts to lateral rib parts 10*b*.

Second Exemplary Embodiment

Figure 6:
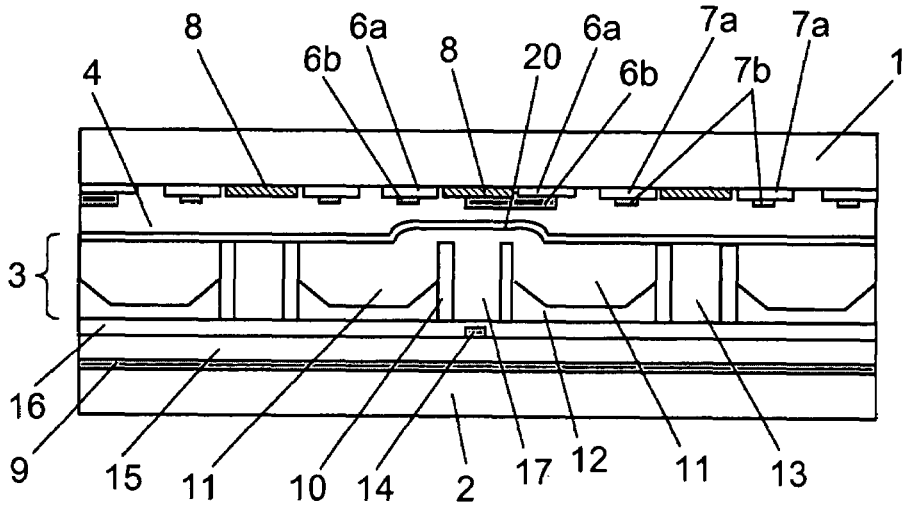
FIG. 6 is a cross sectional view of a PDP according to a second embodiment of the present invention.

FIG. 6 is a cross sectional view of a PDP according to a second embodiment of the present invention, and a clearance is provided by reducing a thickness of dielectric layer 4 on front substrate 1. To be more specific, dielectric layer 4 on front substrate 1 is made thinner in a portion corresponding to the barrier ribs which form priming discharge cells 17 by applying a convex patterning onto front substrate 1 side, thereby forming priming slit 20 as the clearance. Thus, priming particles can be stably supplied to at least adjacent main discharge cells 11.

Figure 7:
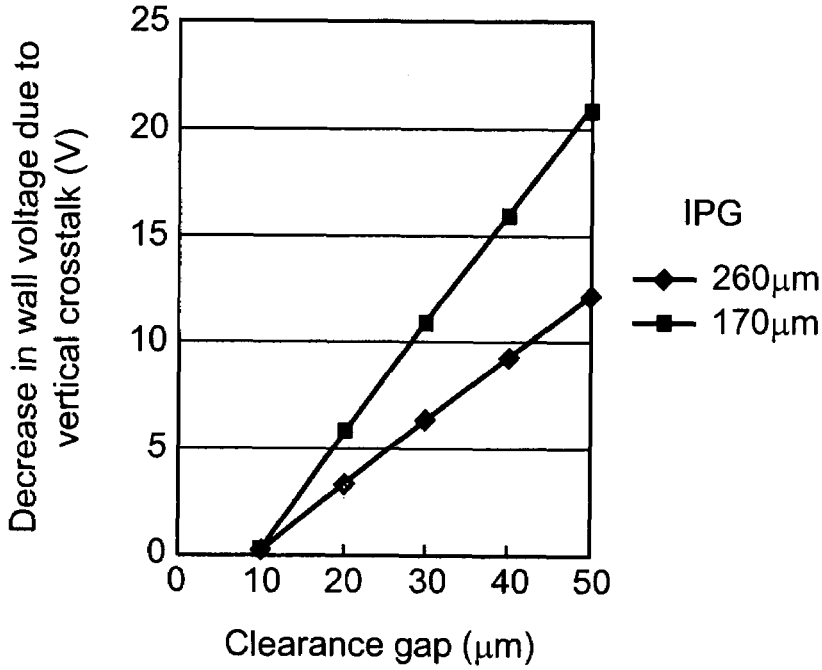
FIG. 7 is a view showing a relation between a clearance gap and crosstalk.

FIG. 7 shows a relation between a clearance gap and the amount of crosstalk. In FIG. 7, the horizontal axis indicates a clearance gap in the unit μm, and the vertical axis indicates a wall voltage (the unit V) reduced by crosstalk between adjacent main discharge cells. Since the wall voltage decreases with increasing crosstalk amount, the vertical axis indicates crosstalk amount. A parameter, IPG stands for Inter Pixel Gap, and indicates the spacing between adjacent main discharge cells 11 as shown in FIG. 2. From FIG. 7, it is known that the clearance which makes crosstalk amount zero is 10 μm or less, regardless of IPG. Therefore, it is necessary to make a clearance gap 10 μm or less in order to reduce crosstalk due to a main discharge. On the other hand, it is known through experiments that the clearance gap for a stable supply of priming particles from priming discharge cells 17 to main discharge cells 11 must be 3 μm or larger. As a result, providing a clearance gap of hot less than 3 μm nor more than 10 μm can stably supply priming particles and reduce crosstalk.

Third Exemplary EMBODIMENT

Figure 8:
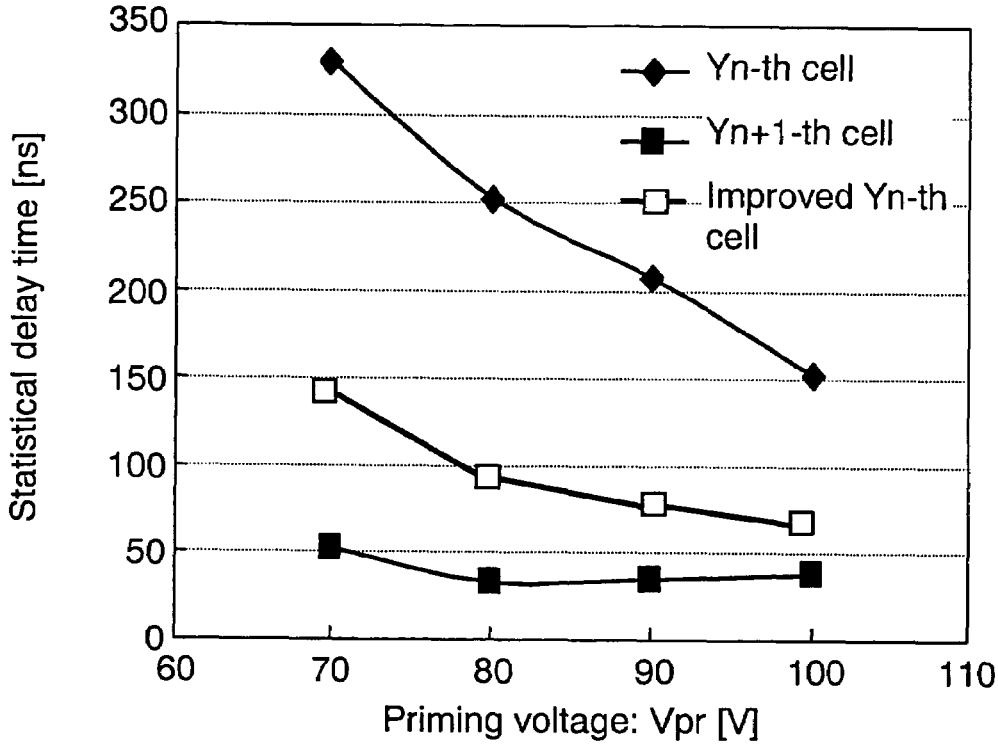
FIG. 8 is a property view showing an example of discharge delay properties with respect to priming voltage in a PDP according to the present invention.

FIG. 8 shows a statistical delay time in discharge with respect to voltage Vpr to be applied to priming electrodes 14 in the case of cells corresponding to scan electrode $Y_n$ and cells corresponding to scan electrode $Y_{n+1}$ which are respectively the n-th and n+1th of scan electrodes 6. When a scan pulse is applied to scan electrode Yn or the n-th of scan electrodes 6, a discharge delay in the n-th cells is rather large because a priming discharge is being performed; however, a discharge delay is decreased by increasing priming voltage Vpr. Since the n+1th discharge cells have been already affected by a priming discharge, a discharge delay is extremely small.

Figure 9:
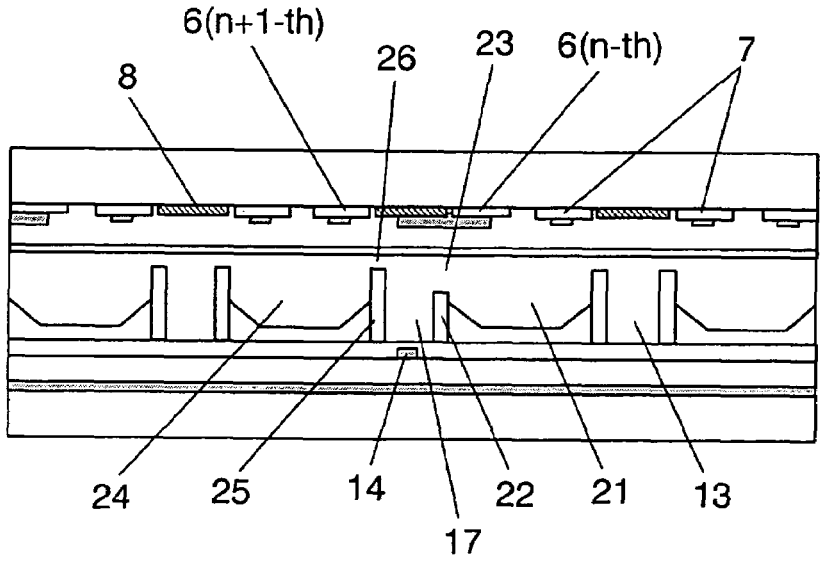
FIG. 9 is a cross sectional view of a PDP according to a third embodiment of the present invention.

FIG. 9 is a cross sectional view of a PDP in a case that in priming discharge cells 17, there is a size difference between clearance 23 above lateral rib part 22 of main discharge cells 21 corresponding to scan electrode $Y_n$ or the n-th of scan electrodes 6 and clearance 26 above lateral rib part 25 of main discharge cells 24 corresponding to scan electrode $Y_{n+1}$ or the n+1th of scan electrodes 6. To be more specific, clearance 23 above lateral rib part 22 of main discharge cells 21 corresponding to scan electrode $Y_n$ or the n-th of scan electrodes 6 is made larger than clearance 26 above lateral rib part 25 of main discharge cells 24 corresponding to scan electrode $Y_{n+1}$ or the n+1th of scan electrodes 6. This structure can increase a supply of priming particles from priming discharge cells 17 to main discharge cells 21 corresponding to scan electrode $Y_n$ or the n-th of scan electrodes 6, thereby reducing a discharge delay. In addition, a supply of priming particles to main discharge cells 24 corresponding to scan electrode $Y_{n+1}$ or the n+1th of scan electrodes 6 is reduced, and false discharge is eliminated, thereby obtaining stable address properties.

FIG. 8 also shows results when lateral rib part 22 is made lower in height than lateral rib part 25, indicating improved n-th cells 21 exhibits reduced discharge delay properties.

Figure 10:
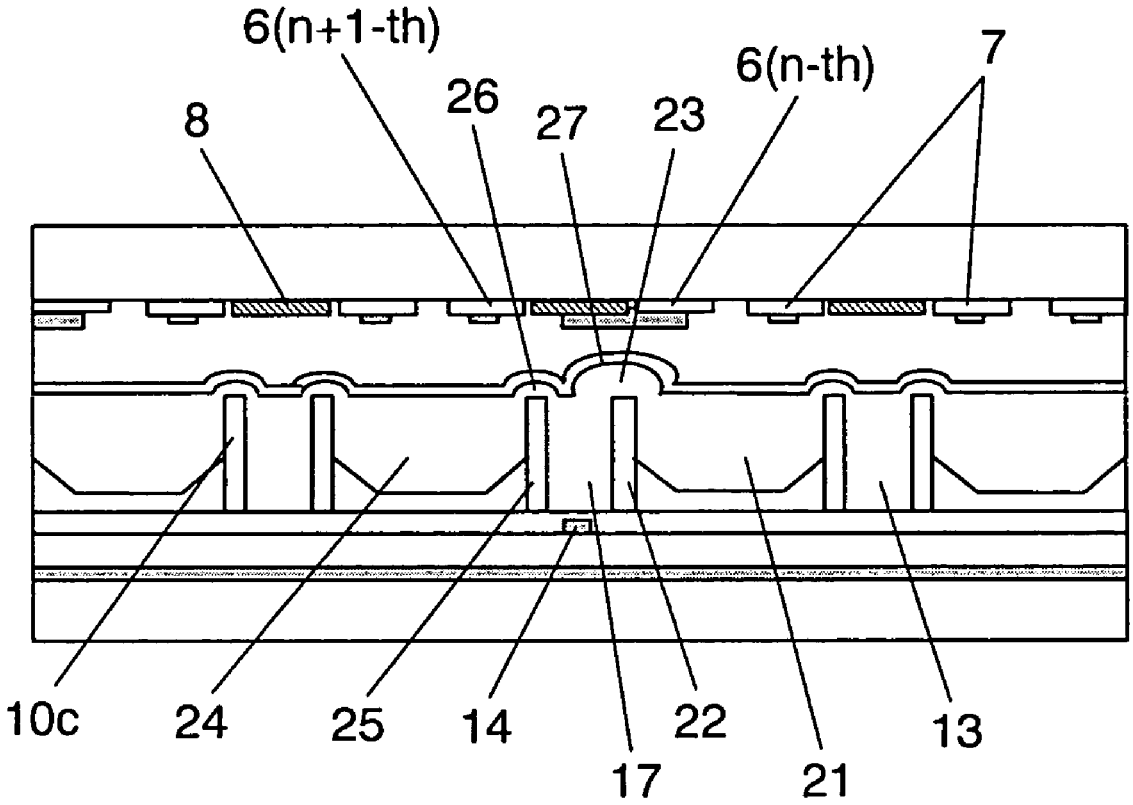
FIG. 10 is a cross sectional view showing another example of the PDP according to the third embodiment of the present invention.

FIG. 10 shows another example of the third embodiment. As shown in FIG. 10, clearance 23, which is formed between front substrate 1 side and lateral rib part 22 provided between main discharge cells 21 corresponding to scan electrode $Y_n$ or the n-th of scan electrodes 6 and priming discharge cells 17, is created by clearance 27 of a deep concave patterned on front substrate 1 side. This can make clearance 23 between n-th main discharge cells 21 and priming discharge cells 17 larger than clearance 26 between n+1th main discharge cells 24 and priming discharge cells 17 so as to reduce variations in discharge delay, thereby obtaining stable address properties. Clearance 26 is also formed on front substrate 1 side corresponding to other lateral rib parts 10*b*. This can improve exhaust performance.

The clearances in the present invention are formed continuous in parallel with priming electrodes 14 at least in the region of priming discharge cells 17 so as to secure the supply of priming particles to each of the main discharge cells by priming discharge expansion.

INDUSTRIAL APPLICABILITY

A plasma display panel of the present invention can supply an appropriate amount of priming particles generated in priming discharge cells to main discharge cells. Furthermore, a discharge delay in address discharge in the main discharge cells can be reduced to improve stable operating properties in high-speed addressing of a PDP compatible with high definition. Therefore, the PDP is useful for a hang-wall TV, a large-size monitor, etc.

The invention claimed is:

1. A plasma display panel comprising:

a first electrode and a second electrode parallel with each other on a first substrate;

a third electrode on a second substrate and extending in a direction orthogonal to the first electrode and the second electrode, the second substrate facing the first substrate with a discharge space therebetween;

a fourth electrode on the second substrate and parallel to the first electrode and the second electrode; and a first discharge space and a second discharge space on the second substrate and partitioned by a barrier rib, wherein a main discharge cell for performing a discharge with the first electrode, the second electrode and the third electrode is in the first discharge space, and a priming discharge cell for performing a discharge with the fourth electrode and at least one of the first electrode and the second electrode is in the second discharge space, the barrier rib and the first substrate have a clearance therebetween, wherein the barrier rib comprises:

a longitudinal rib part extending in a direction orthogonal to the first electrode and the second electrode, and a lateral rib part, extending in a direction orthogonal to the third electrode and parallel with die first electrode and the second electrode, partitioning the first discharge space from the second discharge space, and wherein a pair of first electrodes are arranged next to a pair of second electrodes on the first substrate, and the fourth electrode faces the second discharge space and a plurality of first electrodes which are scan electrodes adjacent to each other.

2. The plasma display panel according to claim 1, wherein the fourth electrode is disposed in the second discharge space, and the barrier rib forming the second discharge space, and the first substrate have a clearance therebetween.

3. The plasma display panel according to claim 1, wherein the clearances are fanned at the bonier ribs.

4. The plasma display panel according to claim 1, wherein the clearances are formed on the first substrate.

5. The plasma display panel according to claim 1, wherein a clearance corresponding to a lateral rib part of an n scanned first electrode among the plurality of first electrodes that is scanned n-th is luger than a clearance corresponding to a lateral rib pan of an n+1 scanned first electrode among the plurality of first electrodes that is scanned n+1th.

6. A plasma display panel comprising:

a first electrode and a. second electrode parallel with each other an a first substrate;

a third electrode on a second substrate and extending in a direction orthogonal to the first electrode and the second electrode, the second substrate facing the first substrate with a discharge space therebetween;

a fourth electrode on the second substrate and parallel to the firs: electrode and the second electrode; and a first discharge space and a second discharge space on the second substrate and partitioned by a barrier rib, wherein a main discharge cell in the first discharge space, for performing a discharge with the first electrode, the second electrode and the third electrode and a priming discharge cell in the second discharge space, for performing a discharge with the fourth electrode and at least one of the first electrode and the second electrode, the barrier rib and the first substrate have a clearance therebetween, wherein the barrier rib comprises:

a longitudinal rib part extending in a direction orthogonal to the first electrode and the second electrode, and a lateral rib part, extending in a direction orthogonal to the third electrode and parallel with the first electrode and the second electrode, partitioning the first discharge space from the second discharge space, and wherein a pair of first electrodes are arranged next to a pair of second electrodes on the first substrate, and the fourth electrode faces the second discharge space and a plurality of first electrodes which are scan electrodes adjacent to each other wherein a clearance corresponding to a lateral rib part of an n scanned first electrode of the plurality of first electrodes that is scanned n-th is larger in size than a clearance corresponding to a lateral rib part of an n+1 scanned first electrode of the plurality of first electrodes that is scanned n+1th.

7. The plasma display panel according to claim 6, wherein the clearances are formed at the barrier ribs.

8. The plasma display panel according to claim 6, wherein the clearances are formed on the first substrate.

* * * * *